US005224420A

United States Patent [19]

Schneider

[11] Patent Number: 5,224,420

[45] Date of Patent: Jul. 6, 1993

[54] SHORT INKING SYSTEM

[75] Inventor: Georg Schneider, Würzburg, Fed. Rep. of Germany

[73] Assignee: Koenig & Bauer Aktiengesellschaft, Wurzburg, Fed. Rep. of Germany

[21] Appl. No.: 896,678

[22] Filed: Jun. 10, 1992

[30] Foreign Application Priority Data

Jun. 12, 1991 [DE] Fed. Rep. of Germany ..... 4119338

[51] Int. Cl.[5] ..... B41F 7/10; B41F 7/24

[52] U.S. Cl. ..... 101/138; 101/177

[58] Field of Search ..... 101/366, 365, 350, 363, 101/207-210, 177, 178, 179-182, 220, 221, 217, 218, 136, 137-140, 142-144, 148

[56] References Cited

U.S. PATENT DOCUMENTS 4,998,475 3/1991 John et al. ..... 101/366

FOREIGN PATENT DOCUMENTS 0278225 1/1988 European Pat. Off. .

OTHER PUBLICATIONS

MAN Publication; Forschen Planen Bauen; 1990/1991 Edition.

*Primary Examiner*—J. Reed Fisher

*Attorney, Agent, or Firm*—Jones, Tullar & Cooper

[57] ABSTRACT

A short inking system for an offset web-fed rotary printing press utilizes a chambered doctor blade which contacts the lower periphery of the screen roller. A dampening system is situated interiorly of the plate cylinder. The axes of rotation of the screen cylinder and of the ink application cylinder are located on a first plane while the axes of the ink application cylinder and the plate cylinder are located on a second plane. The two planes intersect at the axis of rotation of the ink application cylinder and are inclined at an angle between 30° and 60° to the vertical.

4 Claims, 1 Drawing Sheet

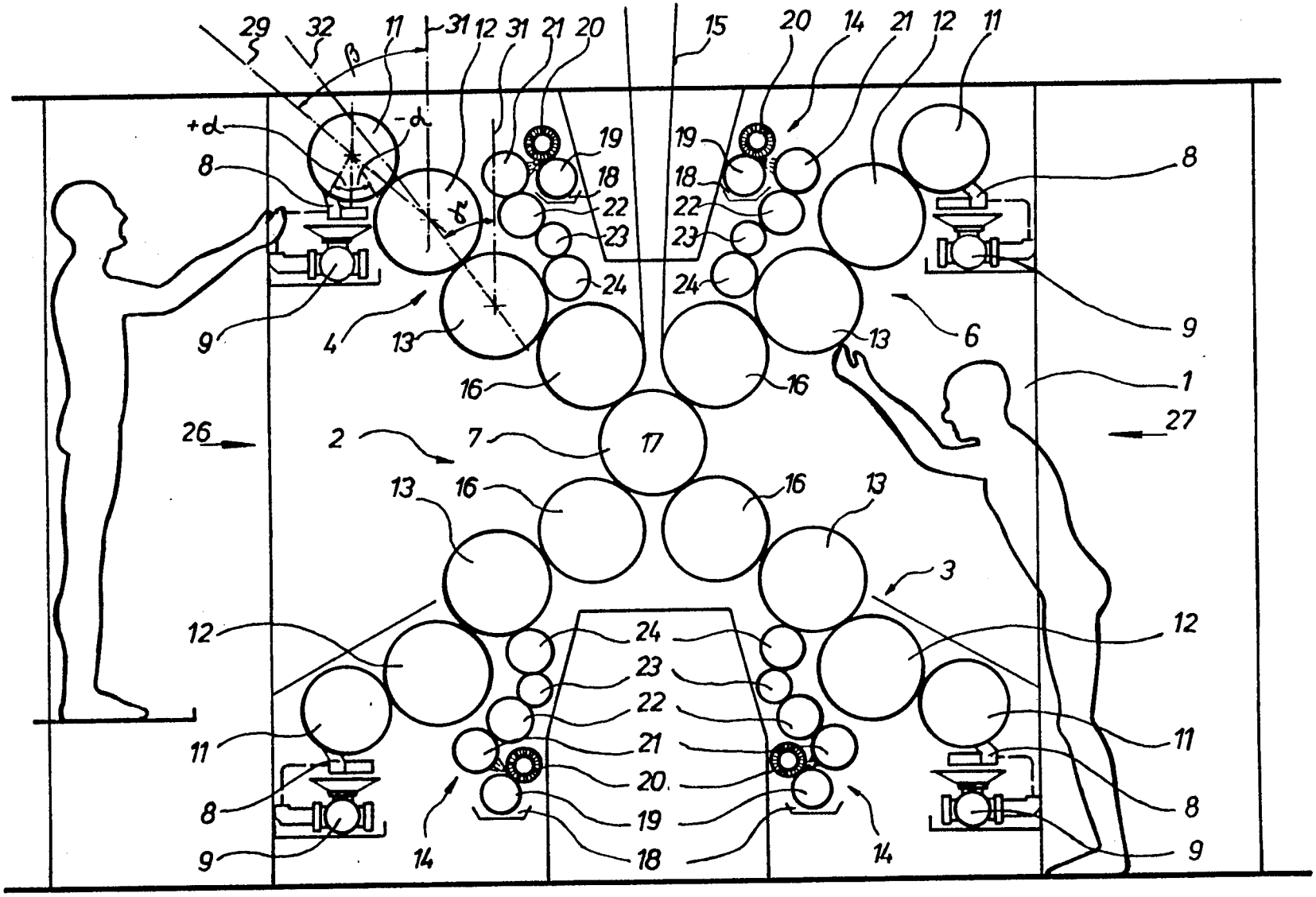
1
2
3
4
6
7
8
9
11
12
13
14
15
16
17
18
19
20
21
22
23
24
26
27
29
31
32
+α
-α
γ

SHORT INKING SYSTEM

FIELD OF THE INVENTION

The present invention is directed generally to a short inking system. More particularly, the present invention is directed to a short inking system for an offset web-fed rotary printing press. Most specifically, the present invention is directed to an upper short inking system for an offset web-fed rotary printing press. The short inking system includes a screen cylinder, an ink application cylinder, a plate cylinder and a rubber-covered blanket cylinder. A doctor blade is used to supply ink to the screened surface cylinder and the doctor blade is positioned beneath the screen cylinder. A dampening system is also provided to supply dampening fluid to the plate cylinder. The dampening system is located inside or interiorly of the plate cylinder. The short inking system affords maximum operational access to the printing press.

DESCRIPTION OF THE PRIOR ART

Short inking units are generally known in the art. Short inking units generally for use with offset web-fed rotary printing presses and specifically for so-called anilox or screen roller offset web-fed rotary printing presses are also known in the art. One such inking system is disclosed in European Patent Document EP-0 278 255 A2.

Another offset web-fed rotary printing press which has short printing systems in the form of anilox, offset inking systems is set forth in the publication, "forschen planen bauen" (Research, Planning, Building) of Gutehoffnungshütte MAN, 1990/91 Edition, page 6, FIGS. 2 to 4.

The anilox, offset inking system that is described in this publication consists of a cylinder that carries a screened shell and that is thus equivalent to a screen roller; a chambered doctor blade, which is positioned laterally with respect to and in cooperation with the screen cylinder; an ink application cylinder; a plate cylinder; a rubber blanket cylinder; and dampening system which dampens the printing plate. The dampening system is positioned on the same side of the plate cylinder as is the chambered doctor blade. In this offset, web-fed rotary printing press assembly, there are two lower inking systems and one upper inking system. The positioning of the various cylinders, chambered doctor blade, and dampening system of the lower inking systems is different from that of the upper system.

In this prior art device, the dampening system is located on the outside of the printing cylinder which means between the printing cylinder and an exterior portion of the assembly. A limitation with this type of inking system lies in that this positioning of the dampening system substantially hampers access to the plate cylinder by the press operator and other personnel. It also requires the use of a laterally located chambered doctor blade.

It will be apparent that a need exists for a short inking system for an offset web-fed rotary printing machine which overcomes the limitations of the prior art devices. The short inking system of the present invention provides such a device and is a significant improvement over the prior art devices.

SUMMARY OF THE INVENTION

It is an object of the present invention to provide a short inking system.

Another object of the present invention is to provide a short inking system for an offset web-fed rotary printing press.

A further object of the present invention is to provide an upper short inking system for an offset web-fed rotary printing press.

Still another object of the present invention is to provide a short inking system having a chambered doctor blade positioned beneath the screen roller.

Even a further object of the present invention is to provide a short inking unit in which the dampening system is positioned interiorly of the plate cylinder.

Still yet another object of the present invention is to provide a short inking unit which affords good access to the plate cylinder.

As will be discussed in greater detail in the description of the preferred embodiment which is set forth subsequently, the upper short inking system in accordance with the present invention utilizes a screen surface ink roller which has a chambered doctor blade in contact with a lower portion of the periphery of the screen roller. An ink application cylinder receives ink from the screen roller and applies it to the plate or plates on the plate cylinder. A dampening system has a dampening fluid application roller which also contacts the plate cylinder. A rubber blanket cylinder receives the inked image from the plate cylinder and applies it to a web of paper in cooperation with a contact cylinder that is cooperating with several such rubber blanket cylinders. The dampening system is positioned interiorly of the plate cylinder and thus is out of the way and does not hinder or limit access to the plate cylinder.

The chambered doctor blade is located beneath the screen roller so that it is in contact with a downwardly oriented portion of the periphery of the screen cylinder within a peripheral angle range which varies to a maximum of $\pm$ 30° with respect to a perpendicular plane extending through the axis of rotation of the screen cylinder. The axes of rotation of the screen cylinder and of the ink application cylinder are located on a first plane. The axes of rotation of the ink application cylinder and the plate cylinder are located on a second plane. The first plane and the second plane each intersect a perpendicular plane at angles $\beta$ and $\Gamma$ between 30° and 60°. The first and second planes intersect along the axis of rotation of the ink application cylinder.

In the upper short inking system which utilizes the present invention there is a substantially greater accessibility to the plate cylinder in spite of a lesser number of cylinders than are used in a "normal" inking system. It is also possible with the present invention to employ a chambered doctor blade that can be positioned in operative connection with the screen roller or screened surface cylinder in the lower portion of the screen roller. This placement of the chambered doctor blade generally at the bottom of the screen roller or at an angle of no more than 30° to one side or the other of the vertical further enhances access to the plate cylinder.

The short inking system of the present invention is easily accessible for accomplishing a change of printing ink as well as accomplishing a change of the chambered doctor blade. Thus, it will be seen that the short inking system of the present invention overcomes the limitations of the prior art devices and is a substantial advance in the art.

BRIEF DESCRIPTION OF THE DRAWINGS

While the novel features of the short inking system in accordance with the present invention are set forth with particularity in the appended claims, a full and complete understanding of the invention may be had by referring to the detailed description of the preferred embodiment, which is presented subsequently, and as illustrated in the accompanying sole drawing figure which is a schematic view of a offset printing system of a web-fed rotary printing press and utilizing the short inking system of the present invention.

DESCRIPTION OF THE PREFERRED EMBODIMENT

Referring now to the sole drawing FIGURE, there may be seen, generally at 1, an offset printing system of a web fed rotary printing press. This is a so-called satellite printing system and it consists of left and right lower printing units and left and right upper printing units. The left and right lower printing units each have a short inking system 2 and 3, respectively, while the left and right upper printing units also have short inking systems 4 and 6, respectively, all in accordance with the present invention. All four of the printing units cooperate with a central pressure cylinder 7 which is covered with a rubber sheet.

Each one of the short inking systems 2, 3, 4 and 6 consists of at least one chambered doctor blade 8, at least one ink supply and ink removal device 9, a screen cylinder 11, an ink application cylinder 12, a plate cylinder 13 with an offset printing plate, a dampening system 14 which moistens the printing plate, and a rubber blanket cylinder 16. The rubber blanket cylinders 16 are disposed so that they can be individually placed against and removed from the central back-pressure cylinder 7. Each of the contact points 17 of the back-pressure cylinder 7 with the rubber sheet cylinders 16 forms a printing point for a paper web 15 which, as may be seen in the drawing, passes between the blanket cylinders 16 and the central pressure cylinder 7. In the rotary printing press depicted in the drawing, there are four printing units so that it is possible to perform a 4/0 printing with the offset printing system as shown.

Each of the dampening systems 14 show in association with one of the printing units could be a brush system, a spray system, or a spinning system as well as any other of the generally known dampening systems. In the drawing, each dampening system 14 is depicted as a brush dampening system. Each one of these brush dampening systems 14 includes a moistening water reservoir 18, a chrome-coated dipping roller 19, a brush roller 20, a chrome roller 21, a rubber-coated first intermediate roller 22, a second intermediate roller 23 with an oleophilic surface, and a rubber-coated moisture application roller 24, which applies an emulsion consisting of the ink and moistening agent to the printing plate carried on the plate cylinder 13 of the printing unit with which the particular dampening system 14 is associated.

In accordance with the present invention, the several dampening systems 14 for the several printing units are located on the inside, or interiorly of the printing units. This means that looking from the direction of the operating sides 26 and 27 of the offset printing systems that these dampening systems 14 are interior of the plate cylinders 13. This affords ease of access to the plate cylinders 13, the blanket cylinders 16 and the central pressure cylinder 17.

Again referring to the sole drawing Figure, the chambered doctor blade 8 is positioned generally beneath the screen cylinder 11. Its blades are in contact with the surface of the screen cylinder 11 in the lower portion of the periphery of the cylinder 11. In accordance with the present invention, the lower portion of the screen cylinder 11 will be understood to be the portion of the periphery which extends into the III and IV quadrants of the periphery up to and including a peripheral angle $\alpha$ of generally $\pm$ 30° with respect to a vertical plane extending up through the axis of rotation of the screen cylinder 11. Thus the chambered doctor blade 8 engages the periphery of the screen roller 11 within the lowermost 60° of periphery of the roller.

In accordance with the present invention, in the upper short inking systems 4 and 6, the centers of rotation of the screen cylinder 11 and of the ink application cylinder 12 are located on a first plane 29 which extends through them. This first plane 29 intersects a perpendicular plane 31 that extends through the axis of rotation of the ink applicator cylinder 12 at an angle $\beta$ between 30° and 60°. The axes of rotation of the ink application cylinder 12 and the plate cylinder 13 of the upper short inking systems 4 and 6 are located on a second plane 32 which intersects the perpendicular plane 31 at an angle $\gamma$ between 30° and 60°. The planes 29 and 32 intersect at the axis of rotation of the ink application cylinder 12.

While a preferred embodiment of a short inking system in accordance with the present invention has been set forth fully and completely hereinabove, it will be apparent that a number of changes in, for example the sizes of the various cylinders, the number of printing plates used, the type of drive means for the cylinders and the like could be made without departing from the true spirit and scope of the present invention which is accordingly to be limited only by the following claims.

What is claimed is:

1. An offset web-fed rotary printing machine comprising:

a central back pressure cylinder;

an upper short inking unit engagement with said back pressure cylinder;

a lower short inking unit in engagement with said back pressure cylinder, said upper short inking unit and said lower short inking unit cooperating with said back pressure cylinder to define an operating side of the printing machine and an interior of the printing machine, said operating side of the printing machine being accessible to a press operator;

said upper short inking unit including:

a screen cylinder;

a chambered doctor blade engagable with a peripheral lower portion of said screen cylinder;

an ink application cylinder in contact with said screen cylinder;

a plate cylinder in contact with said ink application cylinder;

a rubber blanket cylinder in contact with said plate cylinder and said back pressure cylinder; and a dampening system positioned interiorly of said plate cylinder with respect to said operating side of the printing machine and having a moisture application roller in contact with said plate cylinder, whereby a press operator may have access to said plate cylinder of said upper short inking unit on said operating side of the printing machine.

2. The printing machine of claim 1 wherein said chambered doctor blade in said upper short inking unit engages said lower portion of said screen cylinder within a peripheral angle range of 30° to either side of a vertical plane extending through an axis of rotation of said screen cylinder.

3. The printing machine of claim 1 further including an axis of rotation of said screen cylinder and an axis of rotation of said ink application cylinder lying on a first plane, and an axis of rotation of said plate cylinder and said axis of rotation of said application cylinder lying on a second plane, said first and second planes intersecting along said axis of rotation of said ink application cylinder.

4. The printing machine of claim 3 wherein said first and second planes intersect a vertical plane passing through said axis of rotation of said ink application cylinder at an angle between 30° and 60°.

* * * * *